US008572999B2

(12) United States Patent
Kim et al.

(10) Patent No.: US 8,572,999 B2
(45) Date of Patent: Nov. 5, 2013

(54) REFRIGERATOR

(75) Inventors: Ju-Hyun Kim, Changwon (KR); Jong-Min Shin, Changwon (KR)

(73) Assignee: LG Electronics Inc., Seoul (KR)

( * ) Notice: Subject to any disclaimer, the term of this patent is extended or adjusted under 35 U.S.C. 154(b) by 826 days.

(21) Appl. No.: 12/518,820

(22) PCT Filed: Dec. 28, 2007

(86) PCT No.: PCT/KR2007/006983

§ 371 (c)(1), (2), (4) Date: Jul. 28, 2009

(87) PCT Pub. No.: WO2008/082215

PCT Pub. Date: Jul. 10, 2008

(65) Prior Publication Data

US 2010/0018239 A1 Jan. 28, 2010

(30) Foreign Application Priority Data

Dec. 28, 2006 (KR) ..... 10-2006-0136176

(51) Int. Cl.
*F25C 5/18* (2006.01)

(52) U.S. Cl.
USPC ..... 62/344; 62/420; 62/425; 62/347; 62/459

(58) Field of Classification Search
USPC ..... 62/344, 347, 459, 420, 425, 421; 222/146.1
See application file for complete search history.

(56) References Cited

U.S. PATENT DOCUMENTS

| | | | | | |
|---|---|---|---|---|---|
| 3,418,823 | A * | 12/1968 | Salimbeni Vivai | 62/138 |
| 3,621,668 | A * | 11/1971 | Swerbinsky | 62/77 |
| 4,199,956 | A * | 4/1980 | Lunde | 62/138 |
| 5,090,208 | A * | 2/1992 | Aono et al. | 62/347 |
| 5,127,236 | A * | 7/1992 | von Blanquet | 62/135 |
| 6,044,654 | A * | 4/2000 | Igari et al. | 62/186 |
| 6,050,097 | A * | 4/2000 | Nelson et al. | 62/137 |
| 6,735,959 | B1 * | 5/2004 | Najewicz | 62/3.63 |
| 6,945,068 | B2 * | 9/2005 | Kim et al. | 62/353 |
| 6,964,177 | B2 * | 11/2005 | Lee et al. | 62/320 |
| 7,434,417 | B2 * | 10/2008 | Lee | 62/353 |
| 2005/0061016 | A1 * | 3/2005 | Lee et al. | 62/340 |
| 2005/0061018 | A1 | 3/2005 | Kim et al. | |
| 2006/0086131 | A1 * | 4/2006 | Pastryk et al. | 62/344 |

FOREIGN PATENT DOCUMENTS

| | | | |
|---|---|---|---|
| KR | 10-2004-0102571 | A | 12/2004 |
| KR | 10-2005-0028657 | A | 3/2005 |
| KR | 10-2005-0028658 | A | 3/2005 |
| KR | 10-2005-0100126 | A | 10/2005 |
| KR | 10-0531318 | B1 | 11/2005 |

* cited by examiner

*Primary Examiner* — Brandon M Rosati
*Assistant Examiner* — Orlando E Aviles Bosques
(74) *Attorney, Agent, or Firm* — Birch, Stewart, Kolasch & Birch, LLP

(57) ABSTRACT

An ice maker is installed at a refrigerating chamber, and an ice bank is installed at a door of the refrigerating chamber. A cooling air duct extends along a wall surface of the refrigerating chamber and is positioned on an upper side of the ice bank so that ice stored in the inside of an ice bank is prevented from sticking to each other due to the melting of ice.

12 Claims, 4 Drawing Sheets

REFRIGERATOR

TECHNICAL FIELD

This document relates to a refrigerator.

BACKGROUND ART

Generally, a refrigerator is home appliance for storing foods in a low temperature state to maintain them in a fresh state for a long time.

Specifically, the refrigerator comprises a refrigerating chamber maintained at a range of 1 to 4° C. to store foods such as vegetables in a fresh state and a freezing chamber maintained at −18° C. to store foods such meat or fish in a frozen state.

Also, the refrigerator has a type wherein the freezing chamber is positioned on an upper side of the refrigerating chamber, a type wherein the freezing chamber is positioned on a lower side of the refrigerating chamber, and a type wherein the freezing chamber and the refrigerating chamber are provided to be adjacent left and right, according to an installation way.

Also, the refrigerator may be sorted into a side by side door type refrigerator wherein a door is installed left and right, respectively, and a one swing door type refrigerator wherein a door is installed up and down, respectively.

Meanwhile, any one side of the refrigerating chamber or the freezing chamber is provided with an ice-maker for making ice and a container for storing the made ice.

Concretely, when the ice maker and the container are positioned in the freezing chamber, water stored in the ice maker is made into ice by means of a refrigerant passing through an evaporator, wherein the made ice is dropped to the container provided on a lower side of the ice maker and then stored therein.

On the other hand, in the case of some refrigerators, the ice maker is provided in the refrigerating chamber and the container is provided in the door of the refrigerating chamber. In this case, since the refrigerating chamber is maintained at temperature above zero, the ice stored in the container is melted, making it possible to cause a phenomenon that the ice sticks to each other.

In detail, when the ice sticks to each other due to the melting of ice, a problem of applying overload to an ice crusher provided in an inside of the container occurs. More specifically, when the overload is applied to the ice crusher, a phenomenon that components such as a motor driving the ice crusher or a blade crushing ice are damaged occurs. As a result, a lifetime of the container is shorten, thereby causing a disadvantage that additional cost consumed for repairing and replacing the components is not required.

DISCLOSURE OF INVENTION

Technical Problem

It is an object of the present invention to provide a refrigerator capable of maintaining ice stored in a container in a freezing state without the melting of ice.

Specifically, it is an object of the present invention to provide a refrigerator capable of preventing a damage of an ice crusher by preventing a phenomenon that the ice sticks to each other due to the melting of ice stored in the container.

Technical Solution

In order to accomplish the objects, there is provided a refrigerator according to the present invention comprising: a main body having a freezing chamber, an evaporator provided at a rear of the freezing chamber, and a refrigerating chamber provided on an upper side of the freezing chamber; a door opening and closing the refrigerating chamber; an ice maker provided in the inside of the refrigerating chamber; a container provided at a rear surface of the door and storing ice therein; and a cooling air duct whose one end is communicated with a space accommodating the evaporator and is extended along a rear surface and a ceiling of the refrigerating chamber and whose the other end is directed to a front of the refrigerating chamber.

There is provided a refrigerator according to another aspect of the present invention comprising: a main body having a refrigerating chamber provided on an upper side of a freezing chamber; a pair of doors rotatably provided at a front surface of the refrigerating chamber; an evaporator provided at a lower portion of a rear side of the main body; a cooling air duct extended along a ceiling of the refrigerating chamber to guide cooling air generated from the evaporator to the front of the refrigerating chamber; an ice maker provided in an upper space of the refrigerating chamber and exposed to the cooling air of the refrigerating chamber; and a container provided at a rear surface of the door for the refrigerating chamber in which the ice maker is installed, so as to store the ice which is generated in and dropped from the ice maker, wherein the upper surface of the container is opened to directly receive the cooling air discharged from the cooling air duct.

Advantageous Effects

With the refrigerator configured as above according to the present invention, although the container storing ice is provided at the door for the refrigerating chamber, it has an effect of preventing the phenomenon that the ice sticks to each to due to the melting of ice.

Furthermore, the present invention has an effect of preventing the phenomenon that overload is applied to the ice crusher provided in the inside of the container by preventing the phenomenon that the ice sticks to each to due to the melting of ice.

Also, the present invention has an effect of preventing the damage of the components such as the motor driving the ice crusher and the blade crushing ice by preventing the phenomenon that overload is applied to the ice crusher. As a result, it has an advantage that the lifetime of the container is long so that additional cost consumed for repairing and replacing the components is not required.

In addition, since an end portion of a cooling duct is provided at the front of the refrigerating chamber, the present invention has an effect that an air curtain is formed by the discharged cooling air.

Moreover, the present invention has an effect of lowering manufacturing cost of the refrigerator by using the cooling air supplied through the evaporator, without having a separate freezing maintaining apparatus for preventing the melting of ice stored in the inside of the container exposed to the refrigerating chamber.

MODE FOR THE INVENTION

Hereinafter, concrete embodiments of the present invention will be described with reference to the accompanying drawings. It should be understood that the spirit of the present invention is limited to embodiments to be proposed and other retrogressive inventions or other embodiments belonging to the scope of the present invention can be easily proposed by addition, modification, and deletion of other components.

Figure 1:
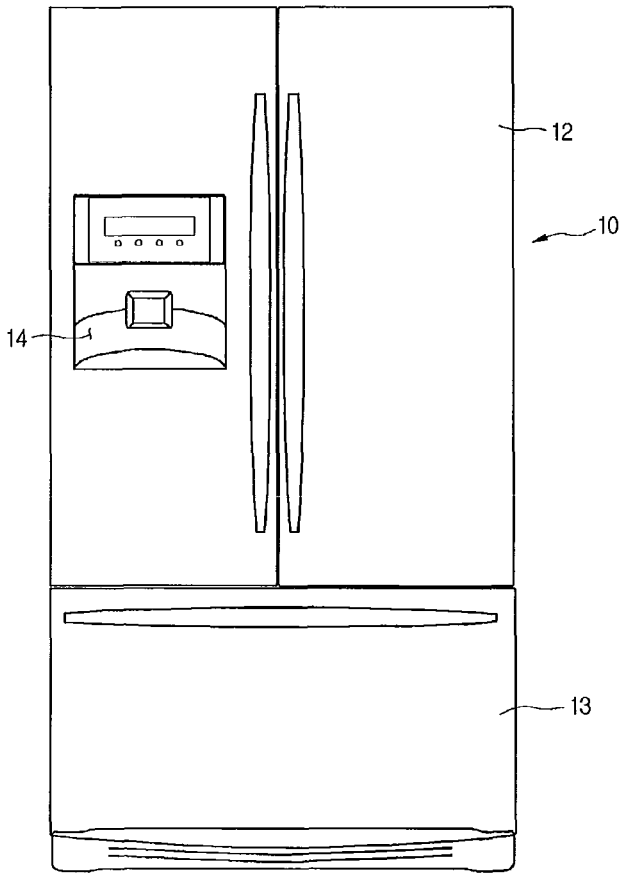
FIG. 1 is a front view of a refrigerator according to an embodiment of the present invention.
Figure 2:
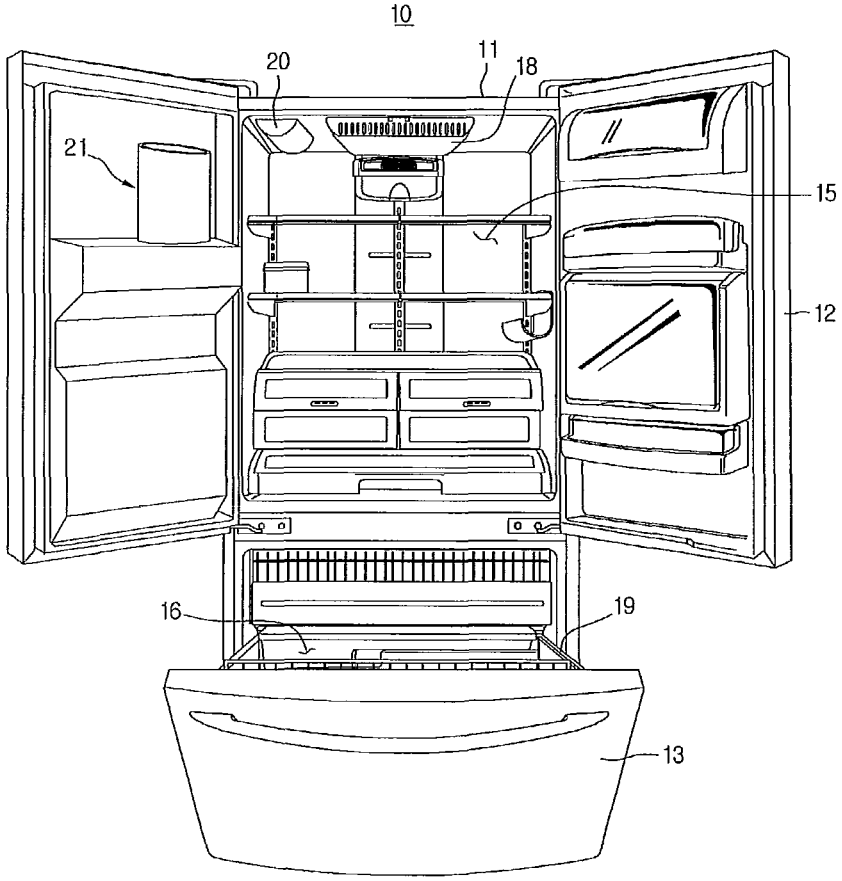
FIG. 2 is an internal perspective view of a refrigerator according to an embodiment of the present invention.

FIG. 1 is a front view of a refrigerator according to an embodiment of the present invention and FIG. 2 is an internal perspective view of a refrigerator according to an embodiment of the present invention.

Referring to FIGS. 1 and 2, the refrigerator according to an embodiment of the present invention will be described with reference to, as an embodiment, a bottom freezer type wherein a refrigerating chamber is provided on an upper side and a freezing chamber is provided on a lower side.

Specifically, the refrigerator 10 according to one embodiment of the present invention comprises a main body 11 having a refrigerating chamber 15 and a freezing chamber 16 provided on an upper side and a lower side, respectively, a door 12 for the refrigerating chamber opening and closing the refrigerating chamber 15, a door 13 for the freezing chamber opening and closing the freezing chamber 16. In detail, the refrigerating chamber 15 and the freezing chamber 16 are separated by a barrier 111 (see FIG. 3).

Also, one side surface of a ceiling of the refrigerating chamber 15 is provided with an ice maker 20 and a cooling duct 18 is extended along wall and ceiling surfaces of the refrigerating chamber. And, the door 12 for the refrigerating chamber is rotatably installed at front surfaces of the left and right of the main body 11, respectively. And, a dispenser 14 capable of dispensing water and ice is installed at any one front surface of the door 12 for the refrigerating chamber 15.

On the other hand, the door 13 for the freezing chamber 16 is provided in a drawer form and a basket 19 storing frozen foods is detachably provided at a rear surface of the door 13 for the freezing chamber 16.

In detail, both sides of a rear surface of the door 13 for the freezing chamber are provided with door frames extended backward. The side surfaces of the door frame and the freezing chamber 16 are connected by means of a rail member. Therefore, the door 13 for the freezing chamber is drawn out in a horizontal direction by means of the rail member.

Also, the rear surface of the door 12 for the refrigerating chamber 15 installed with the ice maker 20 is installed with an ice bank 21 storing ice. Therefore, ice made in the ice maker 20 is deiced so that it is dropped to the ice bank 21.

An upper surface of the ice bank 21 is opened and in the state where the door 12 for the refrigerating chamber 15 is closed, an opening part of the ice bank 21 is positioned at a lower portion of the ice maker 20. And, ice can be made by directly supplying cooling air to the ice maker 20 or by providing a separate refrigerant pipe. In the present embodiment, the ice maker 20 can be configured of a structure having the separate refrigerant pipe. And, in the case of the structure where the refrigerant pipe is provided in the ice maker 20, it has an advantage in rapidly making ice when the ice maker 20 is exposed to the cooling air for the refrigerating chamber with a relatively high temperature. Therefore, in the refrigerator with the structure where the ice maker is provided in the refrigerating chamber, the ice maker provided with the refrigerant pipe may be advantageous. The structure and operation of the ice maker 20 provided with the refrigerant pipe will be described in detail below with reference to the accompanying drawings.

On the other hand, in the case where the ice bank 21 is installed at the freezing chamber 16 or the door 12 for the refrigerating chamber 15, when considering characteristics of the refrigerating chamber 15 maintained at temperature above zero, a phenomenon that ice sticks to each other due to the melting of ice can be caused.

In order to solve such a problem, the inside of the ice bank 21 should be always maintained at sub-zero temperature to prevent the melting of ice.

Hereinafter, a method for maintaining the inside of the ice bank 21 in a state where ice is not melted will be described in detail.

Figure 3:
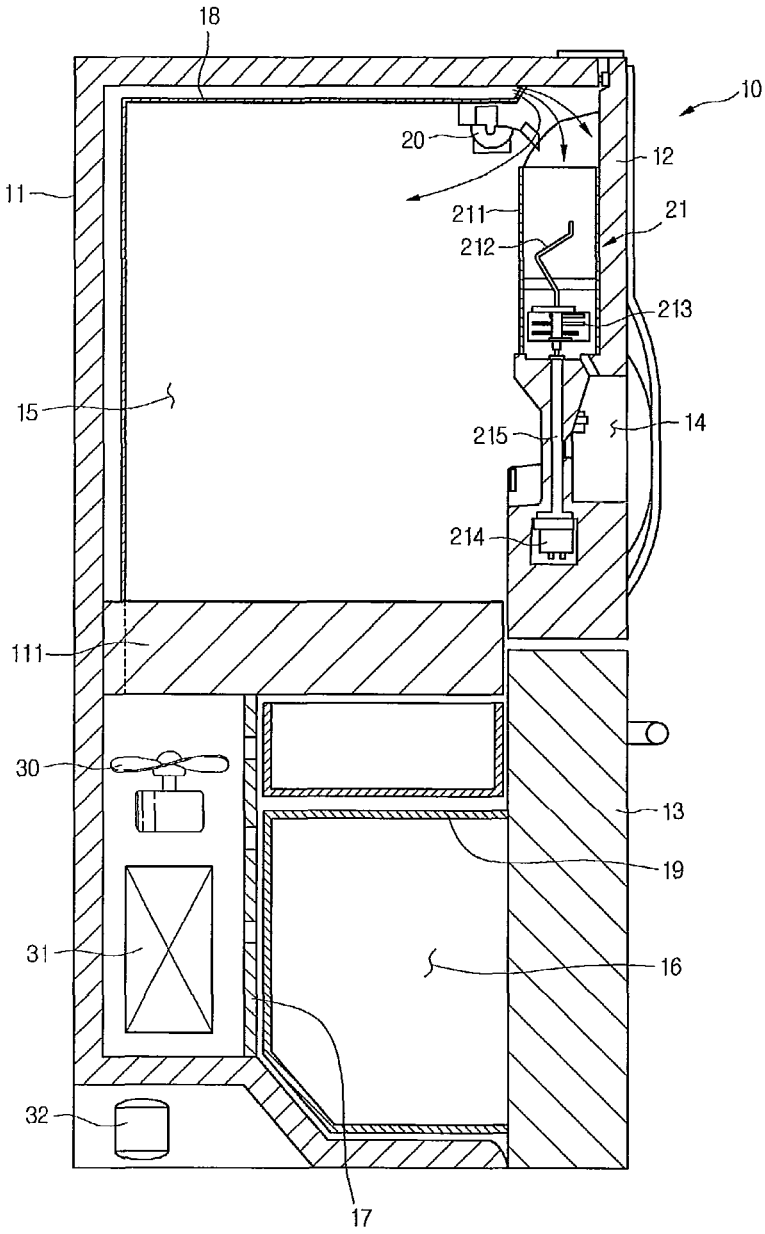
FIG. 3 is a side cross-sectional view showing a structure of a refrigerator according to an embodiment of the present invention.

FIG. 3 is a side cross-sectional view showing a structure of a refrigerator according to an embodiment of the present invention.

Referring to FIG. 3, the refrigerator 10 according to an embodiment of the present invention has a structure that the ice maker 20 and the ice bank 21 is placed in a space of the refrigerating chamber.

Concretely, the refrigerator 10 according to the embodiment of the present invention further comprises a compressor 32 installed at a bottom surface of the freezing chamber 16 to compress a refrigerant, an evaporator 31 installed at a rear of the freezing chamber 16 to form cooing air, and a blowing fan 30 supplying the cooling air formed through the evaporator 31 to the refrigerating chamber 15 and the freezing chamber 16.

Furthermore, the refrigerator 10 comprises a freezing duct 17 supplying the cooling air ventilated from the blowing fan 30 to the freezing chamber 16 and a cooling duct 18 supplying the cooling air to the refrigerating chamber 15. The freezing duct 17 and the cooling duct 18 may be defined by the cooling air duct.

In detail, the freezing duct 17 is provided with a plurality of cooling air holes for discharging the cooling air to the freezing chamber 16. Herein, the evaporator 31 and the blowing fan 30 are disposed in the inside of the freezing duct 17 as well as the evaporator 31 and the blowing fan 30 are disposed in a separate space of the main body 11. The freezing duct 17 connected to the freezing chamber 16 may be formed separately.

Also, the cooling duct 18 is extended from a space accommodating the evaporator 31 and passes through the barrier 111 and then is connected to the refrigerating chamber 15. Herein, the cooling duct 18 may have a structure that it is directly communicated with the space accommodating the evaporator 31 as well as a structure that it is branched from the freezing duct 17.

With the structure as above, the ice made in the ice maker 20 installed at the ceiling of the refrigerating chamber 15 is separated so that it is dropped to the ice bank 21. Herein, a guide extended from the ice maker 20 or the ice bank 21 may be provided so that the ice separated from the ice maker 20 is safely dropped to the ice bank 21.

The ice bank 21 is provided with a container 211 in a cylindrical form whose upper portion is opened, an auger 212 provided at a lower side of the inside of the container to guide ice downward, a crusher 213 integrally connected to a lower end of the auger 212 to crush the ice, a motor 214 driving the crusher 213, and a shaft 215 connecting the motor 214 to the crusher 213 to transfer the rotatory power of the motor.

Also, any one side of the ceiling portion of the refrigerating chamber 15 is provided with the ice maker 20. In detail, the ice maker 20 is disposed at the upper side of the ice bank 21 so that the discharged ice is directly dropped to the container 211 or it is configured to drop the ice to the container 211 by means of the guide after the ice is dropped.

Meanwhile, the cooling duct 18 is communicated with the space accommodating the evaporator 31 and is raised along the wall surface of the refrigerating chamber 15 so that it is extended to the ceiling portion of the refrigerating chamber 15. And, the end portion of the cooling duct 18 is extended to the front of the refrigerating chamber 15 so that it has a structure being positioned on the upper portion of the container 211. Therefore, the cooling air flowing along the cooling duct 18 is discharged to the front thereof, and a portion of the discharged cooling air is dropped to the inside of the container 211 and a remaining portion of the discharged cooling air is circulated in the inside of the refrigerating chamber 15. In addition, the end portion of the cooling duct 18 may be configured to be inclined downward. Therefore, the cooling air flowing along the cooling duct 18 is discharged to the lower portion of the refrigerating chamber 15 so that it may perform a function of a cooling air curtain.

With the structure as above, at least a portion of the cooling air passing through the evaporator 31 to be cooled at low temperature is directly discharged to the container 211, thereby preventing the phenomenon that the ice received in the inside of the container 211 sticks to each other due to the melting of ice.

Also, the cooling duct 18 is extended to the front of the refrigerating chamber 15 and the cooling air discharged from the cooling duct 18 is discharged downward so that an effect of an air curtain can be obtained.

Figure 4:
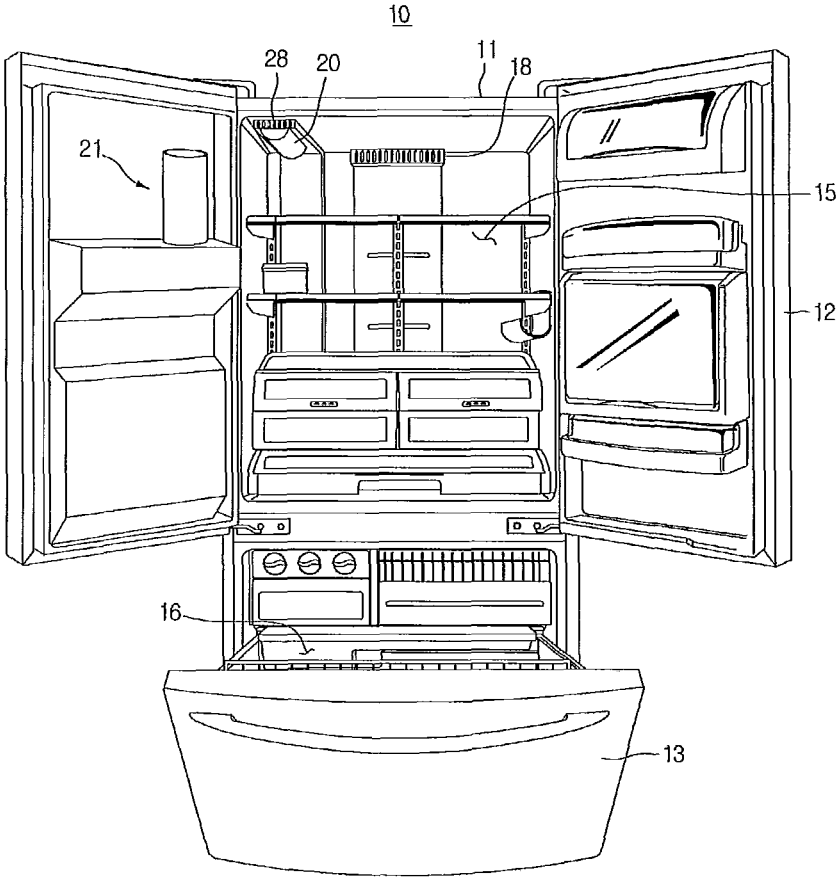
FIG. 4 is a perspective view showing the inside of a refrigerator according to another embodiment of the present invention.

FIG. 4 is a perspective view showing the inside of a refrigerator according to another embodiment of the present invention.

Referring to FIG. 4, the present embodiment has the same configuration as the aforementioned embodiment, however, it has a difference in that an auxiliary duct 28 for transferring the cooling air to the ice bank 21 is configured separately.

In detail, in the aforementioned embodiment, the cooling duct 18 is provided at the middle of the rear wall surface of the refrigerating chamber 15. In this case, in order to smoothly transfer the cooling air to the ice bank 21, a width of the end portion of the cooling duct 18 should be formed to be wider.

However, in the present embodiment, since the auxiliary duct 28 in addition to the cooling duct 18 is provided separately, the width of the cooling duct 18 may be provided to be narrow, as compared to the aforementioned embodiment.

More specifically, the auxiliary duct 28 may have a structure that it is directly connected to the space accommodating the evaporator 31 and may have a structure that it is branched from one side of the cooling duct 18 to be extended along the ceiling the refrigerating chamber 15.

And, the ice maker 20 is installed at a bottom surface of the auxiliary duct 28 so that the cooling air discharged from the auxiliary duct 28 can be directly discharged to the ice bank 21.

As another method, the auxiliary duct 28 is extended along the ceiling surface of the refrigerating chamber, however, its end portion is extended up to a position spaced from the front end of the refrigerating chamber to the rear side, wherein the ice maker 20 may be positioned at the spaced portion. With such a structure, the portion of the cooling air discharged from the auxiliary duct 28 is supplied to the ice maker 20 and the remaining portion thereof is discharged to the ice bank 21.

Figure 5:
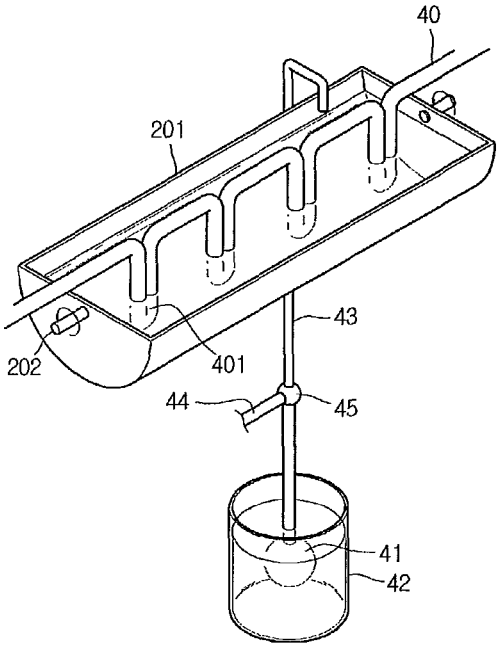
FIG. 5 is a schematic view of a structure of an ice maker provided in a refrigerator according to an embodiment of the present invention.

FIG. 5 schematically shows a structure of an ice maker provided in a refrigerator according to an embodiment of the present invention.

Referring to FIG. 5, the ice maker 20 provided in the refrigerator according to the embodiment of the present invention comprises a tray 201 storing water for making ice, an ice making pipe 40 extended to the inside of the tray 201, and a water supply apparatus for supplying water to the tray 201.

In detail, the water supply apparatus comprises a water pail 42 storing water, a pump 41 pumping the water in the inside of the water pail 42, and a water pipe 43. And, a dispenser connecting pipe 44 can be branched from any one side of the water pipe 43 and a switching valve 45 is installed at the branch point to selectively control a flow direction of water. More specifically, the dispenser connecting pipe 44 is extended to the dispenser so that a user can dispense potable water. And, a rotating axis 202 is extended to both sides of the tray 201. And, the water pail 42 may be buried in the inside of the body 11 or provided at one side of the wall surface of the refrigerating chamber 15.

Further, the ice making pipe 40 is a pipe in which a portion of the refrigerant performing a refrigerant cycle flows. The pipe is curved and bent several times to form projecting parts 401 as shown. And, the projecting part 401 may be formed at a length that can be submerged in water supplied to the tray 201.

Briefly describing the ice making process of the ice maker 20 forming such a structure, potable water for making ice is first supplied from an outside water pipe to the water pail 42. And, when the ice making process starts, the pump 41 is operated so that the water stored in the water pail 42 is supplied to the tray 201. And, when the water supplied to the tray 201 reaches a set water level, the supply of water stops and the refrigerant in low temperature and low pressure flows in the refrigerant pipe 40. The refrigerant pipe 40 is formed in a structure that a portion of the pipes configuring a freezing cycle is branched to be extended to the tray 201. In order words, the refrigerant pipe may be formed in a structure that it is branched from any point of the pipe connected to an inlet side of the evaporator 31 to be extended to the tray 201. And, the refrigerant pipe 40 may be connected back to an inlet side of the compressor 32.

On the other hand, in performing the ice making process, the ice making should be completed before the ice formed in the projection 401 contacts the ice formed at the neighboring projection 401. And, water remaining in the tray 201 is removed. Herein, as a method of removing the remaining water, there may be a method of removing the remaining water by a rotation of the tray 201 or a method of removing the remaining water by a connection of a separate drain pump. And, if the removing of the remaining water is completed, the tray 201 is rotated at 180° and in this state, the ice from the refrigerant pipe 40 is deiced.

In detail, as a method of deicing the ice from the refrigerant pipe 40, there may be a method of flowing a high temperature of refrigerant in the refrigerant pipe 40 in the deicing process or a method of heating the refrigerant pipe 40 by attaching a heater to the surface of the refrigerant pipe 40.

With the process as described above, the deiced ice is directly dropped to the ice bank 21 or dropped thereto by means of the guide. And, the ice dropped to the ice bank 21 is maintained at sub-zero temperature by means of the cooling air supplied from the cooling duct 18 or an auxiliary duct 28. In other words, the phenomenon that a lump of ice stored in the ice bank 21 sticks to each other due to the melting of ice is prevented.

And, the ice maker 20 with the structure that the refrigerant pipe is extended to the inner space of the tray 201 can perform a rapid ice making even when it is directly exposed to the cooling air for the refrigerating chamber. Therefore, a separate heat insulating wall or heat insulating case structure for preventing the ice maker 20 from being exposed to the cooling air for the refrigerating chamber is not needed.

The invention claimed is:

1. A refrigerator, comprising:

a main body having a freezing chamber, an evaporator provided at a rear of the freezing chamber, and a refrigerating chamber provided on an upper side of the freezing chamber;

a door opening and closing the refrigerating chamber;

an ice maker provided within the refrigerating chamber, the ice maker including:

a refrigerant pipe allowing a refrigerant to flow for making ice;

a tray to which water is supplied and in which the refrigerant pipe is immersed below a water level of the tray; and a pump provided at an outside of the tray to supply water to an inside of the tray;

an ice container disposed below the ice maker, the ice container having a front surface mounted on a rear surface of the door, a rearmost surface exposed to an interior of the refrigerating chamber and an opening to receive the ice from the ice maker;

a cooling air duct configured to extend from the freezing chamber to the refrigerating chamber; and a guide member positioned at a space between a lower end of the ice maker and an upper end of the ice container to guide ice dropped from the ice maker to the inside of the ice container, wherein the cooling air duct is mounted on a ceiling of the refrigerating chamber, a first end of the cooling air duct being disposed adjacent to the ice container, wherein the first end of the cooling air duct comprises at least one hole, the at least one hole is the only hole that directs cold air into the refrigerating chamber, the cooling air duct is separated from being in communication with an interior of the refrigerating chamber continuously from a first point to a second point, the first point corresponds to a second end at which the cooling air duct receives the cold air from the evaporator and the second point corresponds to the first end where the at least one hole is located, and the cooling air duct includes no air intake ports in the refrigerating chamber between the first point and the second point, such that all of the cold air discharged from the end of the cooling air duct that is supplied to the ice container reaches the ice container without contacting the ice maker such that ice stored in the container is prevented from melting, and wherein the cold air is supplied to the refrigerating chamber via the space.

2. The refrigerator according to claim 1, further comprising a partition wall partitioning the refrigerating chamber and the freezing chamber, the cooling air duct penetrating through the partition wall to be extended to the refrigerating chamber.

3. The refrigerator according to claim 1, wherein the ice is directly generated on a surface of the refrigerant pipe.

4. The refrigerator according to claim 1, wherein the ice maker is installed at the ceiling surface of the refrigerating chamber.

5. The refrigerator according to claim 4, wherein the ice maker is installed at a bottom surface of the cooling air duct.

6. The refrigerator according to claim 1, wherein the cooling air duct is a main duct which extends along a central portion of a rear surface of the refrigerating chamber and a ceiling portion of the refrigerating chamber.

7. The refrigerator according to claim 6, further comprising an auxiliary duct which extends from another space accommodating the evaporator and extends along a wall surface of the refrigerating chamber at a position spaced from the main duct.

8. The refrigerator according to claim 7, wherein an end portion of the main duct or the auxiliary duct is positioned at an upper side of the container.

9. The refrigerator according to claim 7, wherein an end portion of the auxiliary duct extends up to a point which is spaced rearwards a predetermined distance from the front end of the ceiling of the refrigerating chamber.

10. The refrigerator according to claim 1, wherein the cooling air duct is directly communicated with another space accommodating the evaporator or is branched from a freezing duct which connects the evaporator and the freezing chamber.

11. The refrigerator according to claim 1, wherein an end portion of the cooling air duct has an inclined surface, which is inclined downward, to discharge the cooling air flowing along the cooling air duct downward.

12. The refrigerator according to claim 1, further comprising a dispenser provided at a front surface of the door to which the container is installed to dispense water and/or ice.

* * * * *